US007712271B2

(12) United States Patent
Harrison

(10) Patent No.: US 7,712,271 B2
(45) Date of Patent: May 11, 2010

(54) TILED TRANSITION BRACKET

(76) Inventor: Steven L. Harrison, 1827 Jourdan Ct., Eagan, MN (US) 55122

( * ) Notice: Subject to any disclaimer, the term of this patent is extended or adjusted under 35 U.S.C. 154(b) by 589 days.

(21) Appl. No.: 11/655,541

(22) Filed: Jan. 19, 2007

(65) Prior Publication Data

US 2008/0172962 A1 Jul. 24, 2008

(51) Int. Cl.
*E04B 1/38* (2006.01)
*E04B 1/41* (2006.01)

(52) U.S. Cl. ..... 52/287.1; 52/254; 52/257; 52/716.1; 52/288.1; 52/698

(58) Field of Classification Search ..... 52/831, 52/698, 287.1, 288.1, 254, 256, 257, 716.1, 52/717.05
See application file for complete search history.

(56) References Cited

U.S. PATENT DOCUMENTS 1,917,139 A * 7/1933 McCutcheon ..... 52/254
2,069,289 A * 2/1937 Swendsen et al. ..... 52/288.1
2,207,178 A 7/1940 Richards
2,697,019 A 12/1954 Stefan
2,994,905 A * 8/1961 Franker, Jr. ..... 52/273
3,092,869 A * 6/1963 Stump ..... 16/7
3,228,165 A * 1/1966 Mehrin ..... 52/718.05
3,310,921 A 3/1967 Forcadell
3,411,257 A 11/1968 Yaremchuk
4,014,618 A * 3/1977 Kristiansen ..... 403/205
4,091,586 A * 5/1978 Schwartz ..... 52/287.1
4,601,149 A * 7/1986 Dokan ..... 52/287.1
5,181,357 A 1/1993 Pourtau et al.
5,199,237 A * 4/1993 Juntunen ..... 52/287.1
5,203,640 A 4/1993 Pourtau et al.
5,243,799 A * 9/1993 Schluter ..... 52/282.1
5,256,105 A * 10/1993 Austin ..... 454/187
5,289,663 A 3/1994 Schluter
5,404,684 A * 4/1995 Schwendeman ..... 52/282.5
5,655,345 A 8/1997 Thompson
5,877,451 A * 3/1999 Zimmerman ..... 174/68.3
6,055,789 A * 5/2000 Zimmerman ..... 52/749.1
6,282,855 B1 9/2001 Shipton
6,309,036 B1 * 10/2001 Ancel ..... 312/140.4
6,329,599 B1 * 12/2001 Zimmerman ..... 174/68.3
6,401,418 B1 * 6/2002 Senn et al. ..... 52/506.01
6,516,576 B1 * 2/2003 Balmer ..... 52/287.1
6,591,575 B2 * 7/2003 Benedettini ..... 52/716.1

(Continued)

FOREIGN PATENT DOCUMENTS

EP 0449733 3/1991

(Continued)

*Primary Examiner*—Brian E Glessner
*Assistant Examiner*—Jason Holloway
(74) *Attorney, Agent, or Firm*—Brooks, Cameron & Huebsch, PLLC

(57) ABSTRACT

The present disclosure includes various brackets and methods for forming a tiled transition between a first surface and a second surface, the first and second surfaces forming an inside corner. One bracket embodiment includes a first base portion securable to the first surface, a second base portion securable to the second surface, and a receiving slot angled with respect to the first and second surfaces for receiving a tile strip, wherein the tile strip is permanently secured in the receiving slot to form the tiled transition between the first and second surfaces.

10 Claims, 4 Drawing Sheets

U.S. PATENT DOCUMENTS

| | | | | |
|---|---|---|---|---|
| 6,755,000 | B2 | 6/2004 | Wone Hahn | |
| 2002/0014046 | A1* | 2/2002 | Korn | 52/287.1 |
| 2005/0011159 | A1* | 1/2005 | Standal et al. | 52/716.1 |
| 2007/0125021 | A1* | 6/2007 | Thiers et al. | 52/288.1 |
| 2008/0134602 | A1* | 6/2008 | Schick | 52/287.1 |
| 2009/0139168 | A1* | 6/2009 | Grissom et al. | 52/288.1 |

FOREIGN PATENT DOCUMENTS

| | | | |
|---|---|---|---|
| EP | 0501642 | | 2/1992 |
| EP | 501642 | A1 * | 9/1992 |
| GB | 2412383 | | 3/2004 |
| WO | WO 98/49413 | | 11/1998 |

* cited by examiner

TILED TRANSITION BRACKET

BACKGROUND

In the field of surface covering installation, it can be desirable and/or beneficial to provide transitions between the surface coverings of surfaces forming inside corners. Such inside corners are often at right angles, although inside corners can include surfaces joining at angles greater than or less than ninety degrees. Examples of surfaces forming inside corners include, a wall surface forming an inside corner with another wall surface, a wall surface forming an inside corner with a floor surface, a wall surface forming an inside corner with a ceiling surface, and a backsplash surface forming an inside corner with a countertop surface, among others.

Providing transitions between the surface coverings (e.g., tiles and other types of wall coverings) of surfaces forming inside corners can be aesthetically pleasing and/or can provide sanitary benefits by making the inside corner area easier to clean. In some circumstances (e.g., in commercial kitchens and/or bathrooms), an angled or curved transition between the surface coverings may be dictated by sanitation codes.

As an example, one method of providing a transition between a tiled wall surface and a tiled floor surface includes using cove base tiles. Such cove base tiles are often formed with at least a portion of the tile being formed in a curved shape. Forming the integral curve of a cove base tile can create added time and expense in the manufacturing of the tile.

As such, many tile manufacturers may not produce cove base tiles and/or may only provide cove base tiles in a limited amount of colors, sizes, and/or shapes. In such situations, one desiring to have a particular tile cove base installed may be unable to obtain the particular base or may only be able to obtain it after added expense.

Another method of providing a transition between a tiled floor and wall includes using a floor molding or profiled strip for forming a transition bridge between the floor and the wall. In such cases, the transition bridges are composed of flexible materials such as plastic or metal which remains undesirably exposed at the corner. As such, the transition bridges of these floor moldings and/or profiled strips are often of a second or third material or color/style and, therefore, do not provide uniformity/style continuity between the surface coverings (e.g., tiles) of surfaces forming inside corners.

DETAILED DESCRIPTION

The present disclosure includes various method and device embodiments for forming a tiled transition by using a tiled transition bracket. One device embodiment includes a bracket for forming a tiled transition between a first surface and a second surface, the first and second surfaces forming an inside corner.

In such an embodiment, the bracket can include a first base portion securable to the first surface and a second base portion securable to the second surface. The bracket embodiment includes a receiving slot angled with respect to the first and second surfaces for receiving a tile strip, where the tile strip is permanently secured in the receiving slot to form the tiled transition between the first and second surfaces.

The first and/or second surfaces can include surface coverings such as various types of tiled coverings (e.g., ceramic tiles or wood tiles), among various other types of surface coverings. In various embodiments, the first surface covering can be different than the second surface covering. For instance, the first surface covering can be a ceramic tile covering and the second surface covering can be a wood surface covering.

Figure 1A:
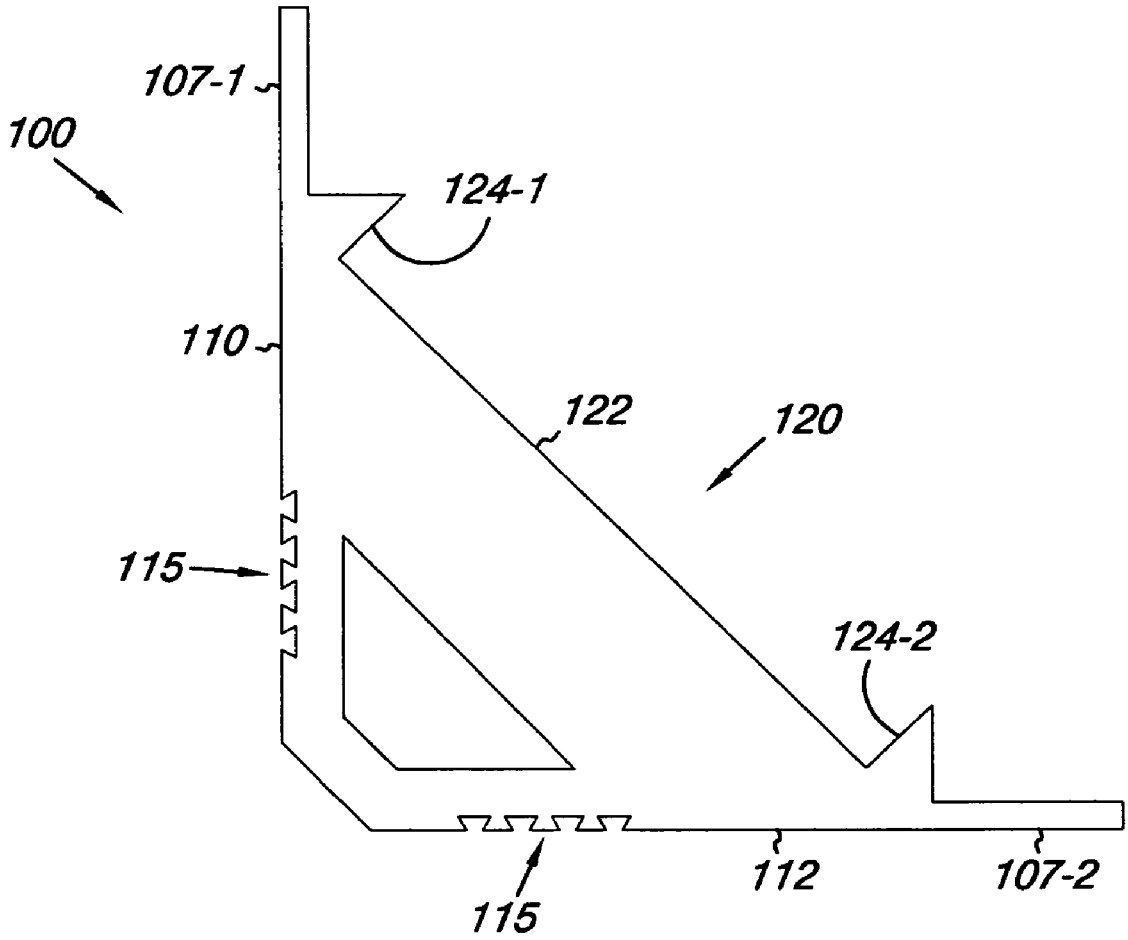
FIG. 1A illustrates a cross-sectional view of a bracket for forming a tiled transition according to an embodiment of the present disclosure.
Figure 1B:
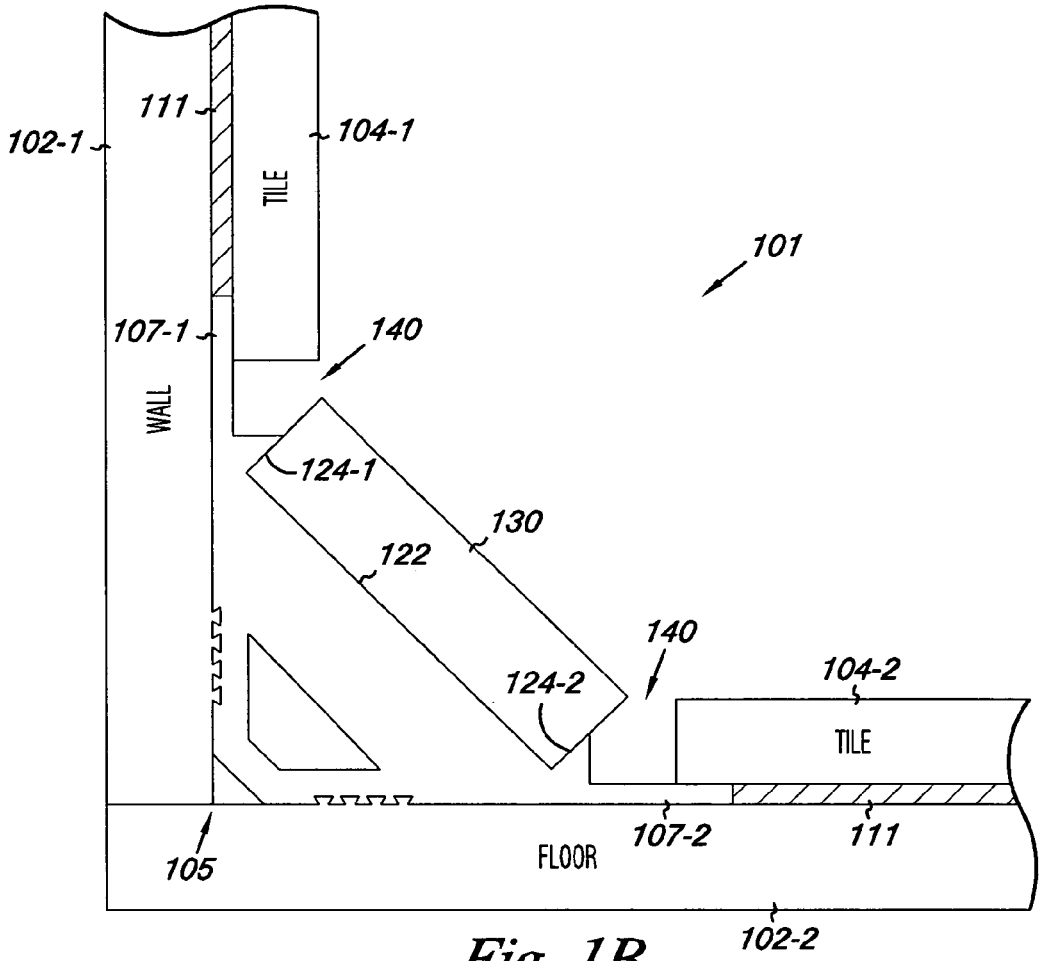
FIG. 1B illustrates a cross-sectional view of an embodiment of a tiled transition formed using the bracket of FIG. 1A.
Figure 1C:
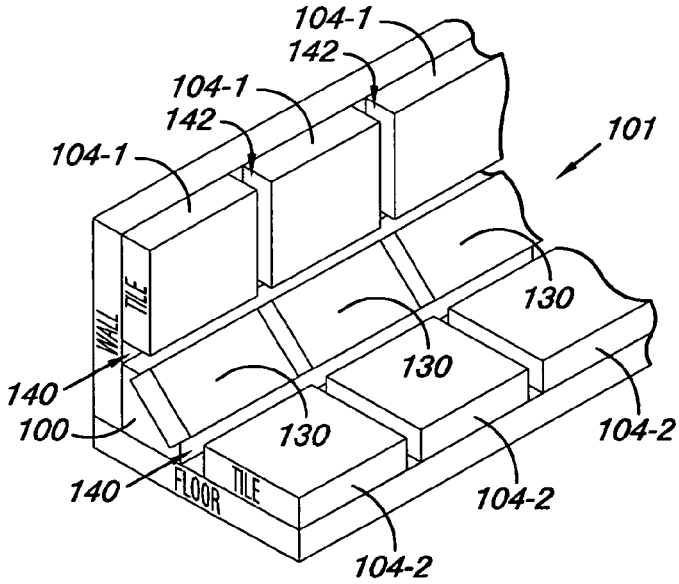
FIG. 1C illustrates a perspective view of an embodiment of a tiled transition formed using the bracket of FIG. 1A.

FIG. 1A illustrates a cross-sectional view of a bracket 100 for forming a tiled transition according to an embodiment of the present disclosure. FIG. 1B illustrates a cross-sectional view of an embodiment of a tiled transition 101 formed using the bracket of FIG. 1A. FIG. 1C illustrates a perspective view of a tiled transition 101 formed using bracket 100.

Various bracket embodiments of the present disclosure (e.g., bracket 100) can be formed of various materials including PVC (polyvinyl chloride), nylon plastic, carbon fiber, aluminum, and/or rubber, among various other materials. The various bracket embodiments can be formed via processes such as extrusion, molding, or machining, among other processes.

As such, bracket embodiments can have various lengths. For instance, the bracket 100 can be the length of a surface covering such as a tile (e.g., 4 inches, 6 inches, 12 inches, or 16 inches, among other lengths). In other embodiments, the bracket 100 can be formed in segments, (e.g. 2 foot, 4 foot, 6 foot, or 10 foot segments) such that the bracket is as long as several surface covering pieces (e.g., several tiles).

In the embodiment illustrated in FIGS. 1A-1C, the bracket 100 includes a first base portion 110 securable to a first surface 102-1 (e.g., a wall, as shown) and a second base portion 112 securable to a second surface 102-2 (e.g., a floor, as shown) forming an inside corner 105. In the example illustrated in FIGS. 1A-1C, the inside corner between the first and second surface forms a right angle.

However, embodiments are neither limited to a particular first and/or second surface nor to inside corners forming right angles. For instance, the first and second surfaces can both be wall surfaces (e.g., wall surfaces forming a vertical inside corner).

The first and/or second surfaces 102-1 and 102-2 can also be a ceiling surface, a countertop surface, a backsplash surface, among other surfaces. The inside corner 105 can be at an angle greater than or less than a right angle.

In the embodiment illustrated in FIGS. 1A-1C, the bracket 100 includes a receiving slot 120 angled with respect to the first and second surfaces 102-1 and 102-2 and located between first and second base portions 110 and 112. In such embodiments, the bracket 100 can include a single slot 120 that is defined by engagement surfaces 122, 124-1, and 124-2.

Figure 2A:
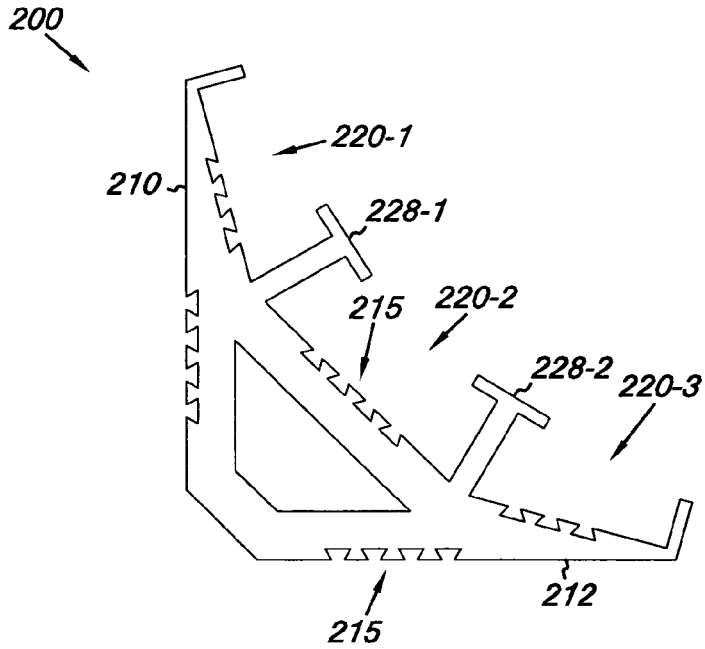
FIG. 2A illustrates a cross-sectional view of another type of bracket for forming a tiled transition according to an embodiment of the present disclosure.
Figure 2B:
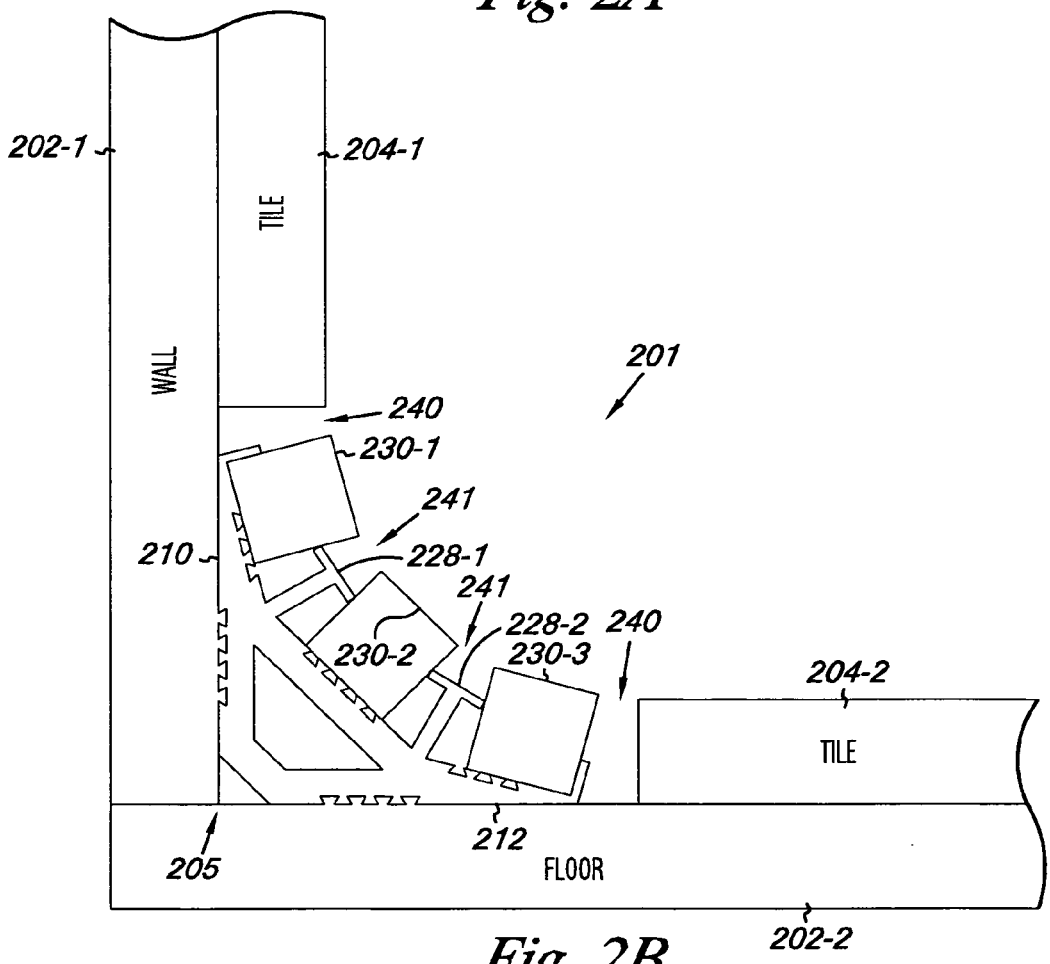
FIG. 2B illustrates a cross-sectional view of an embodiment of a tiled transition formed using the bracket of FIG. 2A.

In various embodiments, and as shown in FIGS. 2A-2B, the bracket can include more than one receiving slot (e.g., 2, 3, 4, or more).

The receiving slot illustrated in the embodiment shown in FIGS. 1A-1C is angled at 45 degrees with respect to the surface 102-1 and 102-2 (e.g., the tiled transition 101 forms an interior transition angle of 135 degrees with respect to the surfaces 102-1 and 102-2). As the reader will appreciate, various other transition angles can be used in the embodiments of the present disclosure (e.g., the receiving slot 120 can be oriented at various other angles).

In the embodiment shown in FIGS. 1A-1C, the bracket 100 also includes a number of channels or grooves 115 in base portions 110 and 112. The channels 115 can be beneficial for ensuring secure bonding of bracket 100 to the surfaces 102-1 and 102-2 via a suitable bonding material such as a thin-set mortar or other adhesive bonding material.

In various embodiments, the bracket 100 can be mechanically fixed to surfaces 102-1 and/or 102-2. For example, embodiments can be nailed and/or screwed to the surfaces in addition to or in substitution for an adhesive material.

In various embodiments, the bracket can include one or more legs extending parallel to the first and/or second surface. In such embodiments, at least a portion of the one or more legs can be covered by a surface covering (e.g., a tile covering) of the surface.

For instance the bracket 100 includes a first leg 107-1 extending parallel to the first surface 102-1 and a second leg 107-2 extending parallel to the second surface 102-2. As shown in FIG. 1B, a portion of the first leg 107-1 is covered by surface covering 104-1 and a portion of the second leg 107-2 is covered by a second surface covering 104-2.

In various embodiments, the legs 107-1 and/or 107-2 can be secured to the respective surface 102-1 and 102-2 via a thin-set mortar 111, other adhesive bonding material, and/or a mechanical fastening mechanism, such as one or more screws and/or nails. In some embodiments, the legs can include channels (e.g., channels 115) or can be perforated to facilitate mechanical bonding to surface 102-1 and/or 102-2. As discussed above, the legs 107-1 and 107-2 may also be secured to the surfaces 102-1 and 102-2 via fasteners (e.g., screws, nails, and/or staples) in addition to, or in lieu of an adhesive bonding material.

The engagement surface (e.g., 122 of receiving slot 120) can also include channels (e.g., similar to channels 115) therein that can be used to securely bond a tile strip 130 to the bracket 100. The channels can have various different shapes and configurations to facilitate a mechanical bond between the transition bracket and a surface (e.g., surface 102-1 and 102-2) and/or between the transition bracket and a tile strip (e.g., tile strip 130).

In some embodiments, the engagement surfaces 122, 124-1, and/or 122-2 can be modified (e.g., treated or manipulated with tools) to facilitate an adequate bond of a thin-set or other bonding material to the bracket. For example, in some embodiments, the adhesion properties of a surface can be improved by exposure to heat, one or more chemicals, and/or other treatment techniques. In some embodiments, a surface can be manipulated, such as by etching or sanding to improve the adhesion properties of the surface.

In some embodiments, the engagement surfaces 122, 124-1, and/or 122-2 can include a bonding material such as a fiberglass coating or other bonding material to facilitate a suitable bond of the tile strip 130 in the receiving slot 120. For example, in some embodiments, the bracket can be made of PVC, in which some types of thin-set mortar may not adequately bond to.

In such instances, portions of, or the entire, bracket can be coated with a bonding agent or intermediate material to facilitate an adequate bond of a thin-set or other bonding material to the bracket. In this manner, a tile strip can be permanently secured to the bracket by using a thin-set mortar or other bonding material.

For example, an intermediate material can be a material having better adhesion qualities than PVC, with respect to the adhesion of thin-set material. The intermediate material can be adhered to the PVC in any suitable manner and the tile can then be adhered using thin-set adhesive material to the intermediate material. Such techniques can be utilized for other types of suitable adhesive materials by using a suitable intermediate material to provide a suitable surface for adhering the tile.

The receiving slot 120 of bracket 100 and tile strip 130, to be secured therein, can have various sizes. As an example, the slot 120 can have a width (e.g., a distance between engagement surface 124-1 and engagement surface 124-2) of about 0.5 inches to 1.75 inches to accommodate a tile strip having a width of about the same size. Embodiments are not so limited to a particular width dimension of the tile receiving slot and/or tile strip and can be considerably larger or smaller.

In various embodiments, more than one tile strip can be placed in a receiving slot (e.g., slot 120). For example, two tile strips could be secured in receiving slot 120. In such embodiments, the tile strips can include a space (e.g., a grout joint) therebetween. For instance, if the receiving slot had a width of about 1.75 inches, the two tile strips could each have a width of about 0.75 inches with a grout joint of about 0.25 inches between the strips.

In various embodiments, the tile strip can be permanently bonded (e.g., permanently secured) in a receiving slot prior to installation of the bracket (e.g., before the bracket 100 is permanently secured to surfaces 102-1 and 102-2). In some embodiments, the bracket 100 can be secured to the surfaces 102-1 and 102-2 prior to the securing of tile strip 130 within receiving slot 120.

In the embodiment illustrated in FIG. 1, the bracket 100 and tile strip 130 secured thereto form a tiled transition 101 between a number of first surface covering elements 104-1 and a number of second surface covering elements 104-2. In such embodiments, the tiled transition 101 can be between two tile surfaces (e.g., tile covering 104-1 on wall surface 102-1 and tile covering 104-2 on floor surface 102-2). The tile coverings 104-1 and 104-2 can be permanently secured to the respective surfaces 102-1 and 102-2 via a bonding material 111 (e.g., a thin-set mortar, mastic, glue, or other adhesive material).

In some embodiments, the tile strip may be the same type of tile as tile coverings. For example, a tile strip can be cut from one or more of the tiles used to cover the surfaces (e.g., surface 102-1 and/or 102-2) using a suitable cutting device (e.g., a wet or dry tile saw). In some embodiments, the tile strip can be formed to a suitable size during manufacture.

In various embodiments, the tile strip used to form the tiled transition can be a different type of material than tile 104-1 and/or 104-2 and/or may have a different color. As an example, the tile 104-1 and/or 104-2 may be a material such as slate or marble, while the tile strip 130 can be a material such as granite, among various other materials.

In various embodiments, and as shown in FIG. 1C, the tile strip 130 can have a length that is the same as the length of the tiles 104-1 and/or 104-2. In such embodiments, the tiled transition 101 can be formed such that a continuous grout joint (e.g., a grout joint 142) occurs between surface coverings 104-1 and 104-2.

A grout joint refers to a gap between individual tiles and/or tile strips that can be filled with a filler material (e.g., a sanded or unsanded grout material). In some embodiments, the tile strips 130 can be staggered and/or have a length different than surface covering 104-1 and/or 104-2 such that grout joint 142 is not continuous (e.g., straight) between the two surface coverings.

In the embodiment shown in FIGS. 1B and 1C, a grout joint 140 is depicted between the tile strip 130 and the surface coverings 104-1 and 104-2. In some embodiments, the surface coverings adjacent the tile strip 130 (e.g., tile 104-1 and 104-2 in the example of FIGS. 1B and 1C) may abut the tile strip such that no grout joint 140 exists.

Figure 4:
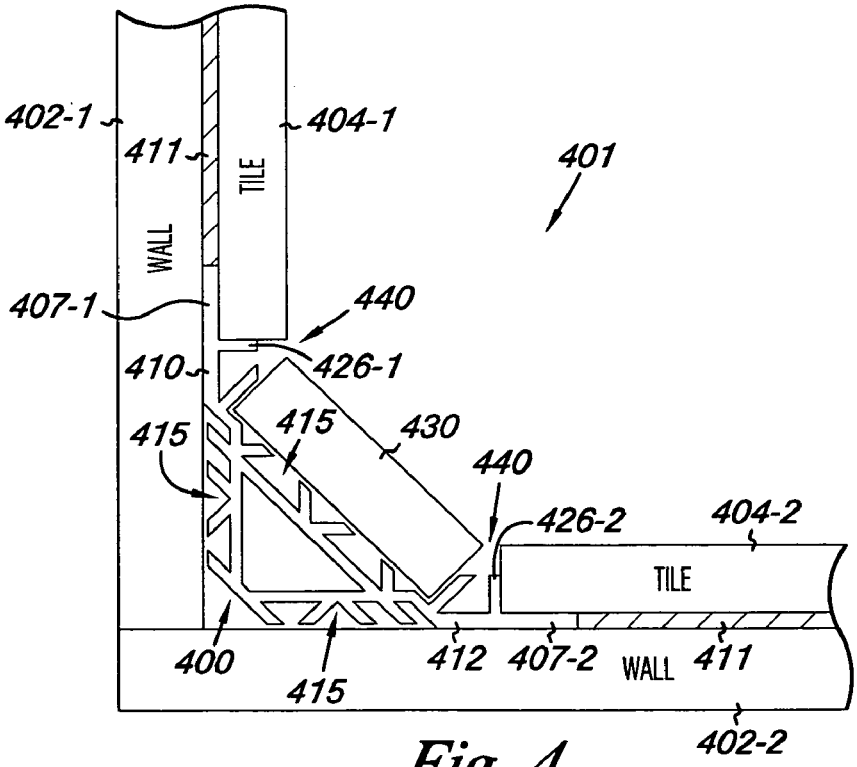
FIG. 4 illustrates a cross-sectional view of a tiled transition using a bracket embodiment in accordance with present disclosure.

In some embodiments (e.g., as shown in FIG. 4) one or both of the first and second base portions (e.g., 110 and 112) may include a spacer member located a distance from the receiving slot (e.g., 120). In such embodiments, the spacer member can extend out from a base portion of the bracket (e.g., perpendicular to the surface (e.g., 102-1 and 102-2) to which the base portion is secured).

As described below, the spacer member can be used to maintain a grout joint (e.g., 140) between a tile strip (e.g., 130) and a surface covering (e.g., 104-1 and 104-2). The spacer member can also be used as a support member to support one or more surface coverings (e.g., tiles) as other surface coverings are secured to a surface (e.g., a wall surface). Such embodiments can therefore, provide support to tile mounted vertically, for example, which may aid in mounting tile and in the length of time needed for adhesion.

Also, the support member may provide a straight surface for guiding the placement of tile on a surface. As such, some embodiments may aid in the speed of tile placement, among other benefits.

In various embodiments, the bracket 100 can be designed to be unviewable when the tiled transition 101 has been grouted (e.g., when grout joints 140 and 142 have received a filler material therein). The unviewable nature of such embodiments can be desirable and/or beneficial. For instance, one desiring to have a tiled transition (e.g., tiled transition 101) between two tiled surfaces (e.g., tiled surfaces 102-1 and 102-1) may not want to have a viewable transition made of a material other than a tile material (e.g., a material such as a metal or plastic).

In some embodiments, such as the embodiment shown in FIG. 3 and described below, a portion of the bracket may be visible when the tiled transition has been grouted. As described below, in such embodiments, the visible portion of the bracket may be a portion of one or more spacer or support members of the bracket.

The visible portion may be made of various materials such as metals or colored plastics and can provide a profile strip in place of one or more grout joints (e.g., joints 140). Such profile strips can be designed to be decorative in nature, in some embodiments.

FIG. 2A illustrates a cross-sectional view of another type of bracket 200 for forming a tiled transition according to an embodiment of the present disclosure. FIG. 2B illustrates a cross-sectional view of an embodiment of a tiled transition 201 between a first surface 202-1 and a second surface 202-2 formed using the bracket of FIG. 2A. In the embodiment illustrated in FIGS. 2A and 2B, the first and second surfaces include respective surface coverings 204-1 and 204-2 secured thereto.

In the embodiment illustrated in FIGS. 2A-2B, the bracket 200 includes a first base portion 210 securable to the first surface 202-1 (e.g., a wall, as shown) and a second base portion 212 securable to the second surface 202-2 (e.g., a floor, as shown) forming an inside corner 205.

In various embodiments, the bracket can include a number of receiving slots between the first and second base portions for receiving tile strips to form the tiled transition 201. In the embodiment of FIGS. 2A and 2B, the bracket 200 includes three receiving slots 220-1, 220-2, and 220-3 for receiving tile strips 230-1, 230-2, and 230-3, respectively. The receiving slots are each angled with respect to the first and second base portions 210 and 212. In various embodiments, and as shown in FIGS. 2A and 2B, the receiving slots can each be angled with respect to each other.

In various embodiments, the tiled transition can be a coved (e.g., rounded) transition. That is, the tile strips can form a coved transition when secured in the receiving slots.

The radius of curvature of the tiled transition can depend on various factors such as the number of receiving slots in the bracket and/or the width of the receiving slots and/or the tile strips, among various other factors. For instance, in some embodiments, the coved transition can have a radius of curvature of, for example, more than ⅜ inch. Such embodiments may be beneficial in use where health codes enforcing such cove radius regulations are enforced, such as in restaurants and other establishments.

In various embodiments, the bracket can include one or more spacer members formed between the receiving slots. In the embodiment of FIGS. 2A and 2B, the bracket 200 includes a first spacer member 228-1 formed between receiving slots 220-1 and 220-2 and a second spacer member 228-2 formed between receiving slots 220-2 and 220-3.

The size and/or shape of the spacer members 228-1 and 228-2 can any suitable dimension. In various embodiments, the spacer members can be used to maintain a particular grout joint (e.g., grout joint 241) between tile strips (e.g., tile strips 230-1 to 230-3). The width of the grout joint can, for example, be ⅛ inch, 3⁄16 inch, or ¼ inch, among other widths.

In various embodiments, (and, as described in connection with FIG. 4) at least one of a first base portion and second base portion of the bracket can include a spacer member for maintaining a gap between one of the tile strips and a covering (e.g., a tile) of the surface to which the base portion is secured. For example, in the embodiment illustrated in FIGS. 2A and 2B, the base portion 210 secured to wall surface 202-1 can include a spacer member (e.g., spacer member 426-1 shown in FIG. 4) for maintaining a gap 240 (e.g., a grout joint) between tile strip 230-1 and tile 204-1.

In the embodiment illustrated in FIGS. 2A and 2B, the bracket 200 also includes a number of channels or grooves 215 in base portions 210 and 212 and in receiving slots 220-1 to 220-3 that can be used for ensuring secure bonding of bracket 200 to the surfaces 202-1 and 202-2 and/or of tile strips 220-1 to 220-3 to the bracket 200.

Figure 3:
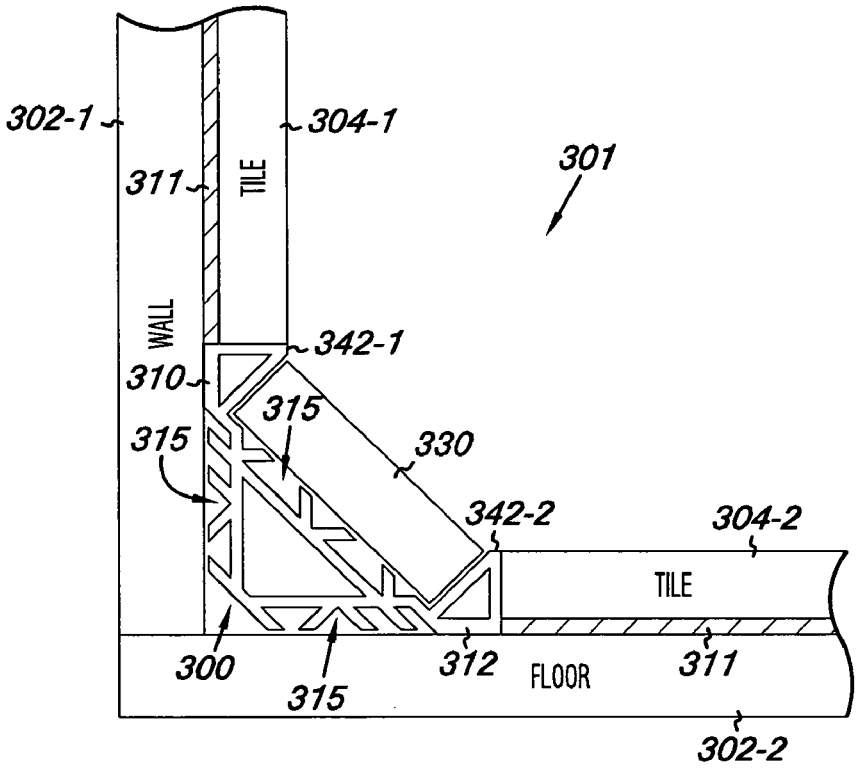
FIG. 3 illustrates a cross-sectional view of a tiled transition using a bracket embodiment in accordance with present disclosure.

FIG. 3 illustrates a cross-sectional view of a tiled transition 301 using a bracket embodiment 300 in accordance with present disclosure. The tiled transition 301 is a tiled transition between a first surface covering 304-1 of a first surface 302-1 and a second covering 304-2 of a second surface 302-2. In the embodiment of FIG. 3, the first surface covering 304-1 and the second surface covering 304-2 are tiles secured to respective surfaces with a bonding material 311 (e.g., thin-set mortar, glue, mastic, etc.).

In the embodiment illustrated in FIG. 3, the bracket 300 includes a first base portion 310 securable to the first surface 302-1 (e.g., a wall, as shown) and a second base portion 312 securable to the second surface 302-2 (e.g., a floor, as shown). The bracket 300 also includes a number of grooves 315 that can facilitate bonding of the bracket to the surfaces 302-1 and 302-2 and/or bonding of a tile strip 330 to the receiving slot of bracket 300.

In the embodiment of FIG. 3, the bracket 300 includes two spacer members 342-1 and 342-2 that maintain a gap between tile strip 330 and the adjacent tile coverings 304-1 and 304-2, respectively. The spacer members 342-1 and 342-2 can also be used as a support member to prevent one or more surface coverings (e.g., tile 304-1) from sliding down a wall due to gravity when the surface covering is being installed, for example. Such surfaces can also be used as a guide for setting a covering on a surface, as discussed above.

In the embodiment illustrated in FIG. 3, the spacer members 342-1 and 342-2 are viewable when the tiled transition 301 has been grouted. The visible portion may be made of various materials such as metals or colored plastics and can provide a profile strip in place of one or more grout joints (e.g., joints 140 shown in FIG. 1C).

FIG. 4 illustrates a cross-sectional view of a tiled transition 401 using a bracket embodiment 400 in accordance with present disclosure. The tiled transition 401 is a tiled transition between a first surface covering 404-1 of a first surface 402-1 and a second covering 404-2 of a second surface 402-2. In the embodiment for FIG. 4, the first surface covering 404-1 and the second surface covering 404-2 are tiles secured to respective surfaces with a bonding material 411 (e.g., thin-set mortar, glue, mastic, etc.).

In the embodiment illustrated in FIG. 4, the bracket 400 includes a first base portion 410 securable to the first surface 402-1 (e.g., a wall, as shown) and a second base portion 412 securable to the second surface 402-2 (e.g., a different wall, as shown). The bracket 400 also includes a number of grooves 415 that can facilitate bonding of the bracket to the surfaces 402-1 and 402-2 and/or bonding of a tile strip 430 to the receiving slot of bracket 400.

In the embodiment illustrated in FIG. 4, the first and second base portions 410 and 412 include a spacer member 426-1 and 426-2, respectively. The spacer members 426-1 and 426-2 are located a distance from the receiving slot of bracket 400 and extend out from base portions 410 and 412.

The spacer members can be used to maintain a grout joint 440 between tile strip 430 and surface coverings 404-1 and 404-2. The spacer members can also be used as a support member to support one or more surface coverings as described above. In the embodiment of FIG. 4, the spacer members 426-1 and 426-2 are perpendicular to the respective surfaces 402-1 and 402-2, but embodiments are not limited to perpendicularly extending spacer members.

In the embodiment of FIG. 4, the bracket 401 includes a first leg 407-1 extending parallel to the first surface 402-1 and a second leg 407-2 extending parallel to the second surface 402-2. The first leg 407-1 is covered by surface covering 404-1 and the second leg 407-2 is covered by a second surface covering 404-2.

The legs 407-1 and/or 407-2 can be secured to the respective surface 402-1 and 402-2 via a suitable bonding material 411. In some embodiments, the legs can include channels (e.g., channels 415) or can be perforated to facilitate mechanical bonding to the surface. The legs 407-1 and 407-2 may also be secured to the surfaces 402-1 and 402-2 via screws and/or staples in addition to, or in lieu of an adhesive bonding material, as discussed above.

Although specific embodiments have been illustrated and described herein, those of ordinary skill in the art will appreciate that an arrangement calculated to achieve the same results can be substituted for the specific embodiments shown. This disclosure is intended to cover adaptations or variations of various embodiments of the present disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A bracket for forming a tiled transition between a first surface and a second surface, the first and second surfaces forming an inside corner, comprising:

a first base portion securable to the first surface;

a second base portion securable to the second surface; and a receiving slot angled with respect to the first and second surfaces and configured to receive a tile strip permanently secured therein to form the tiled transition between the first and second surfaces;

wherein the receiving slot is defined by:

a first engagement surface for engaging a first side surface of the tile strip;

a second engagement surface for engaging a second side surface of the tile strip; and a third engagement surface angled with respect to the first and second engagement surfaces and positioned between the first and second engagement surfaces and configured for attachment of a bottom surface of the tile strip thereto; and wherein a width of the receiving slot is defined by a distance between the first and the second engagement surfaces, and wherein a width of the tile strip is configured to be about the same as the width of the receiving slot;

wherein the bracket includes a first leg extending beyond the first engagement surface and a second leg extending beyond the second engagement surface; and wherein the first and second engagement surfaces are substantially perpendicular to the third engagement surface, with the first engagement surface and the second engagement surface projecting from an area between the first and second base portions.

2. The bracket of claim 1, wherein the first surface includes a first covering and the second surface includes a second covering, and wherein at least one of the first covering and the second covering includes a tile covering.

3. The bracket of claim 2, wherein a length of the tile strip is the same as a length of a tile of the at least one tile covering that is adjacent to the bracket.

4. The bracket of claim 2, wherein the first leg extends parallel to the first surface and the second leg extends parallel to the second surface, and wherein at least a portion of the first leg and the second leg are covered by the first covering and the second covering.

5. The bracket of claim 1, wherein the bracket is unviewable when the tiled transition is grouted.

6. The bracket of claim 1, wherein the first and second surfaces are wall surfaces.

7. The bracket of claim 1, wherein the tiled strip is permanently secured in the receiving slot prior to the bracket being secured to the first and second surfaces.

8. The bracket of claim 1, wherein the receiving slot is configured to have the tile strip permanently adhered to at least one of the first, second, and third engagement surfaces.

9. The bracket of claim 1, wherein the tile strip is a rectangular tile strip.

10. The bracket of claim 2, wherein the receiving slot is configured such that a continuous tiled transition is formed between an edge of the first covering and an edge of the second covering.

* * * * *